US010791388B2

(12) United States Patent
Bigeh

(10) Patent No.: US 10,791,388 B2
(45) Date of Patent: Sep. 29, 2020

(54) SHOCK-MOUNTED AND POSITIONAL BOUNDARY MICROPHONE

(71) Applicant: Audix Corporation, Wilsonville, OR (US)

(72) Inventor: Fred Bigeh, Wilsonville, OR (US)

(73) Assignee: Audix Corporation, Wilsonville, OR (US)

( * ) Notice: Subject to any disclaimer, the term of this patent is extended or adjusted under 35 U.S.C. 154(b) by 0 days.

(21) Appl. No.: 16/383,578

(22) Filed: Apr. 13, 2019

(65) Prior Publication Data

US 2019/0379960 A1 Dec. 12, 2019

Related U.S. Application Data

(60) Provisional application No. 62/681,145, filed on Jun. 6, 2018.

(51) Int. Cl.
*H04R 1/08* (2006.01)
*H04R 1/40* (2006.01)

(52) U.S. Cl.
CPC ..... *H04R 1/083* (2013.01); *H04R 1/406* (2013.01)

(58) Field of Classification Search
CPC .. H04R 1/083; H04R 1/406; H04R 2201/021; H04R 2201/40; H04R 2420/07; H04R 1/08; H04R 29/005; H04M 3/568; H04M 3/567; H04M 2201/40; H04M 3/562
See application file for complete search history.

(56) References Cited

U.S. PATENT DOCUMENTS

2016/0353200 A1* 12/2016 Bigeh ..... H04R 1/326
2018/0234752 A1* 8/2018 Slaton ..... F16F 7/14

* cited by examiner

*Primary Examiner* — Sunita Joshi
(74) *Attorney, Agent, or Firm* — Klarquist Sparkman, LLP

(57) ABSTRACT

One or more boundary microphones is mounted with elastic shock cords and is mounted within a housing such that the microphone is isolated from other components to isolate the microphone and improve audio performance. Each microphone in a preferred embodiment is angularly adjustable to allow the microphone to be pointed toward a desired audio signal source.

16 Claims, 5 Drawing Sheets

SHOCK-MOUNTED AND POSITIONAL BOUNDARY MICROPHONE

TECHNICAL FIELD

The present invention relates to boundary microphones, and more particularly, a boundary microphone that is mounted in a housing such that the microphone assembly is suspended over a mounting surface with elastic suspension elements such as shock cords to isolate the microphone assembly and decouple the microphone from the housing.

BACKGROUND

A boundary microphone is a microphone that is positioned near to, or flush with a surface—a "boundary." Typically, boundary microphones are used for speech or instruments and the mics are placed on or mounted to boundaries such as conference tables. With boundary microphones the microphone capsule is hard-mounted to the housing that contains the capsule. But vibration or other disturbances at the boundary can cause vibration at the mic level; as such, dampening materials are sometimes used between the hard-mounted mic and the housing to minimize negative effects of vibration.

There are known benefits from using boundary mics, including for example, when used to record speech or music because a boundary microphone prevents phase interference between direct and reflected sound, resulting in a natural sound with a flatter frequency response than can be obtained with a stand-mounted microphone at the same distance. By placing the diaphragm of the microphone capsule parallel to and facing the plate boundary provided by the microphone package, the reflected sound delay is reduced, and the resulting comb filter interference frequencies are high enough that they are outside the audible range.

The present invention is defined by a shock-mounting system that isolates the microphone capsule of a boundary mic to completely isolate the mic from other components in the housing. More specifically, the microphone described herein is mounted with elastic shock cords that suspend the microphone in the housing. In an embodiment, one or more microphones may be mounted according to the invention in a housing and each microphone is angularly adjustable so that the microphone points at a desired source of an audio signal, such as a meeting participant or an instrument.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF ILLUSTRATED EMBODIMENTS

The invention will now be described in detail with reference to the drawings. It will be understood that relative directional terms are used at times to describe components of the invention and relative positions of the parts. As a naming convention, the plane of a boundary (i.e., surface) on which the boundary microphone housing is mounted is considered for this description to be a generally horizontal surface (although in practice the boundary could have any orientation relative to the ground plane). The ceiling is a plane that in most installations is parallel to the floor, though not always. Other relative directional terms correspond to this convention: "upper" refers to the direction above and away from the ground plane; "lower" is generally in the opposite direction, "inward" is the direction from the exterior toward the interior of the adaptor, "vertical" is the direction normal to the horizontal ground plane, and so on.

Figure 6:
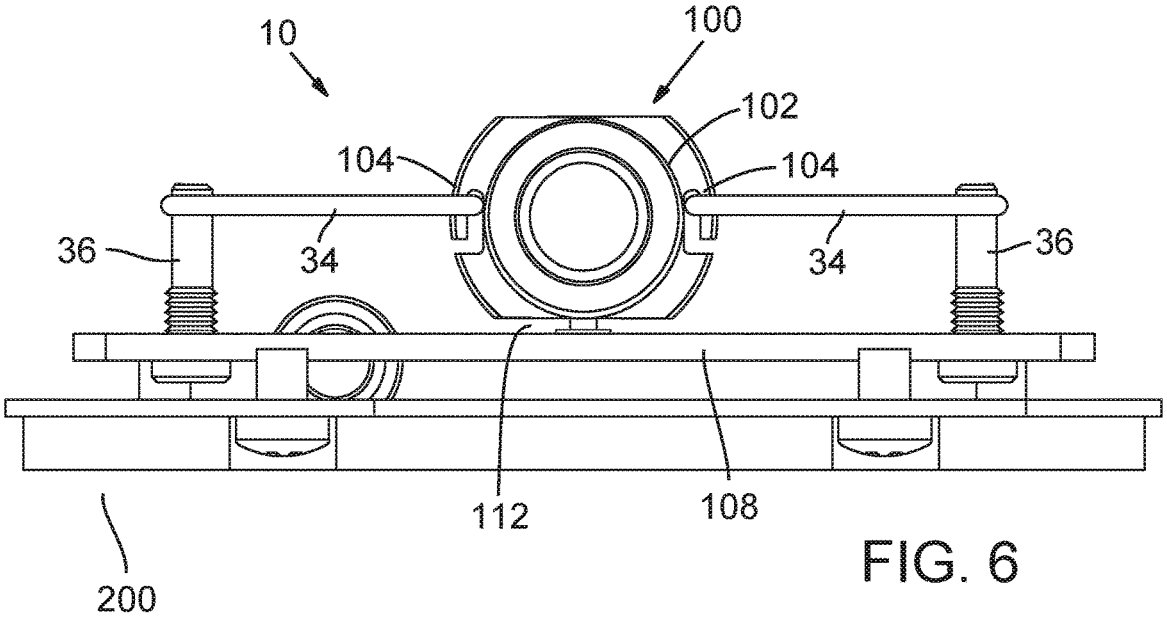
FIG. 6 is a front elevation view of the boundary microphone shown in FIG. 5.
Figure 7:
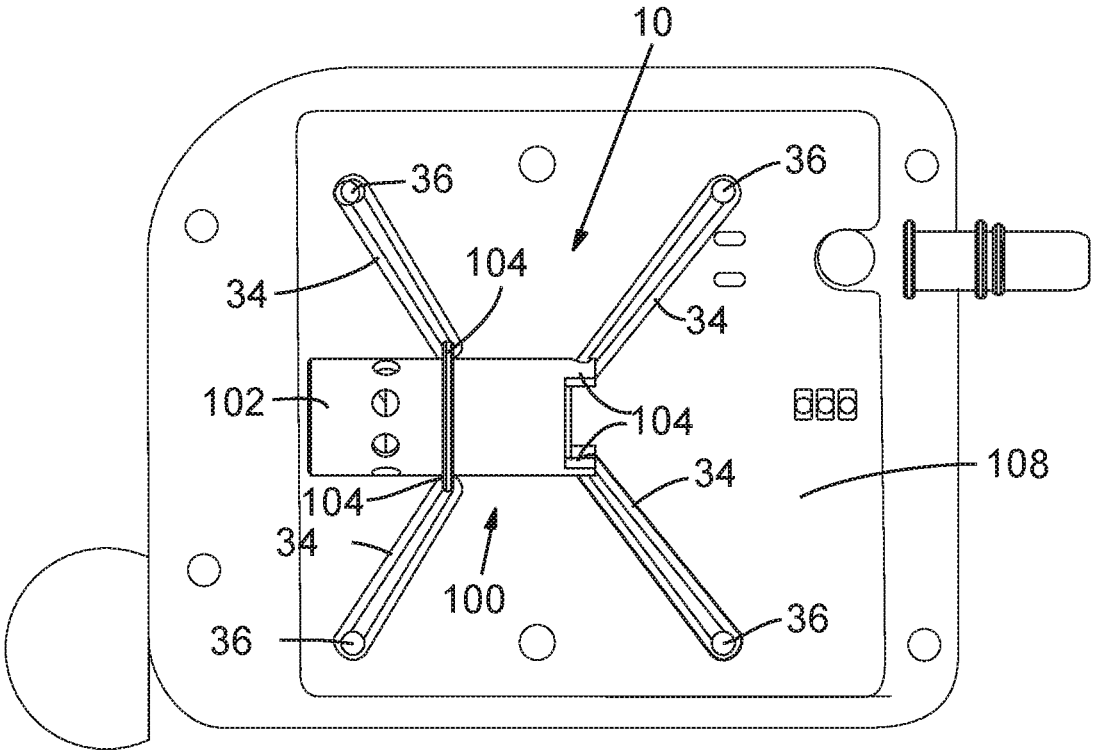
FIG. 7 is a top plan view of the boundary microphone shown in FIG. 5.
Figure 8:
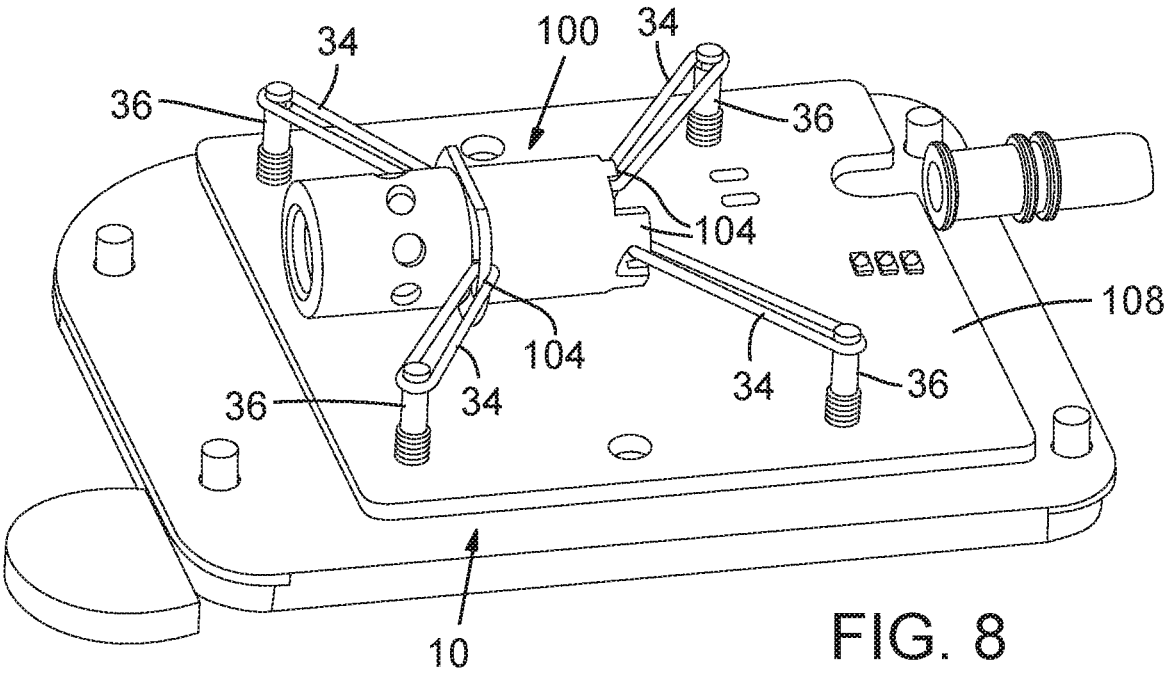
FIG. 8 is an upper perspective view of the boundary microphone according to the invention and as shown in FIG. 5.

With reference to all of the figures it will be understood that the boundary microphone assembly 10 comprises housing base 12 that mounts one or plural individual microphone assemblies 100, and that the assembly 10 will include a grille, which is not shown but which attaches to the housing base 12 and which provides a protective and functional enclosure for the one or more microphone assemblies 100—in the drawings the grille is not shown in order to better illustrate the invention (although a grille housing 200 is shown schematically in FIG. 6—of course the grille is not in contact with the microphone assembly 100). Cabling and electronics, electrical connections are similarly omitted but will be understood by those of skill in the art. Like numbers are used throughout the specification and drawings to identify like structures and features.

Figure 1:
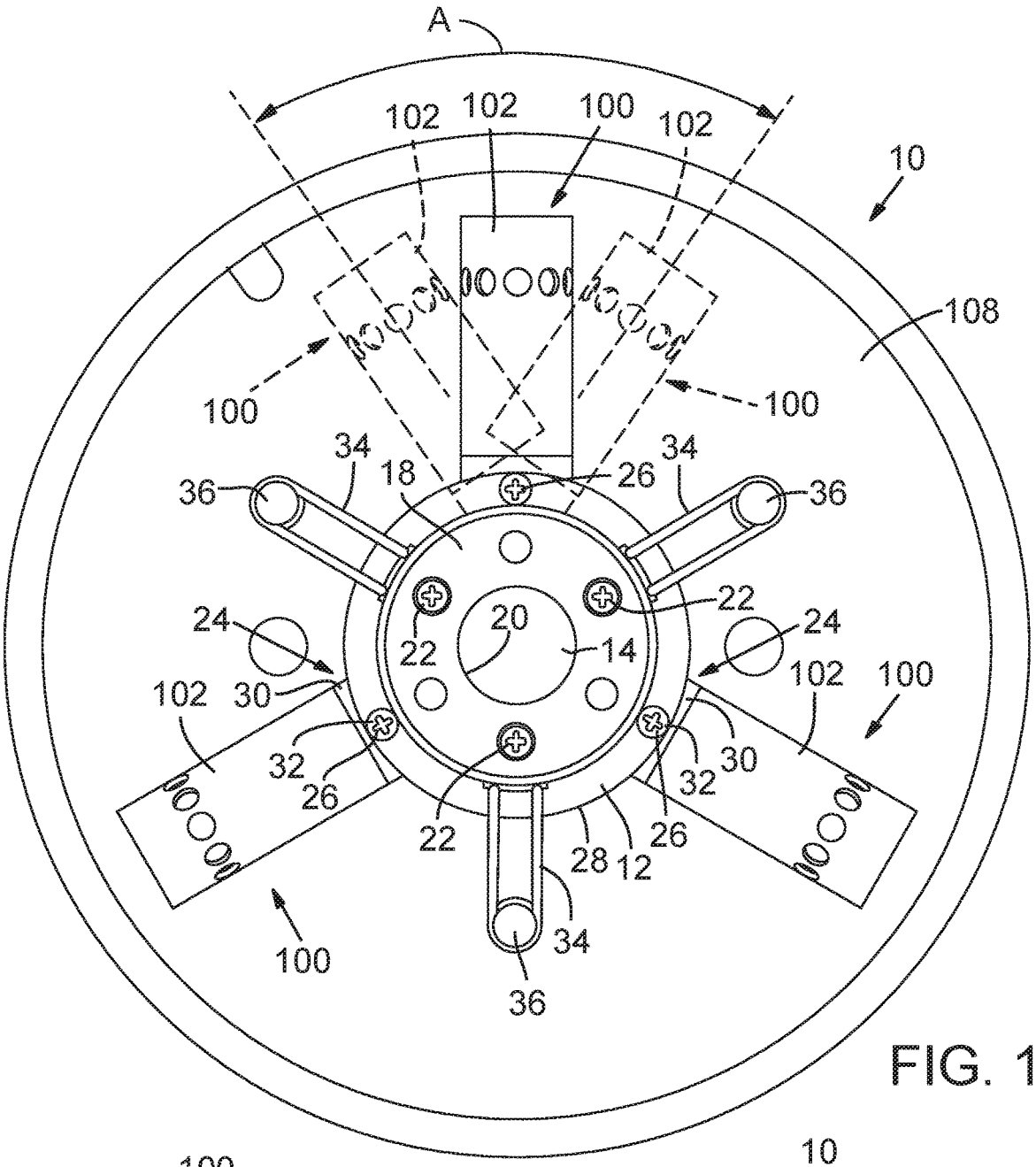
FIG. 1 is a top plan view of an array of three boundary microphones mounted to a common shock-mounted hub, in which each of the three microphones is angularly adjustable.
Figure 2:
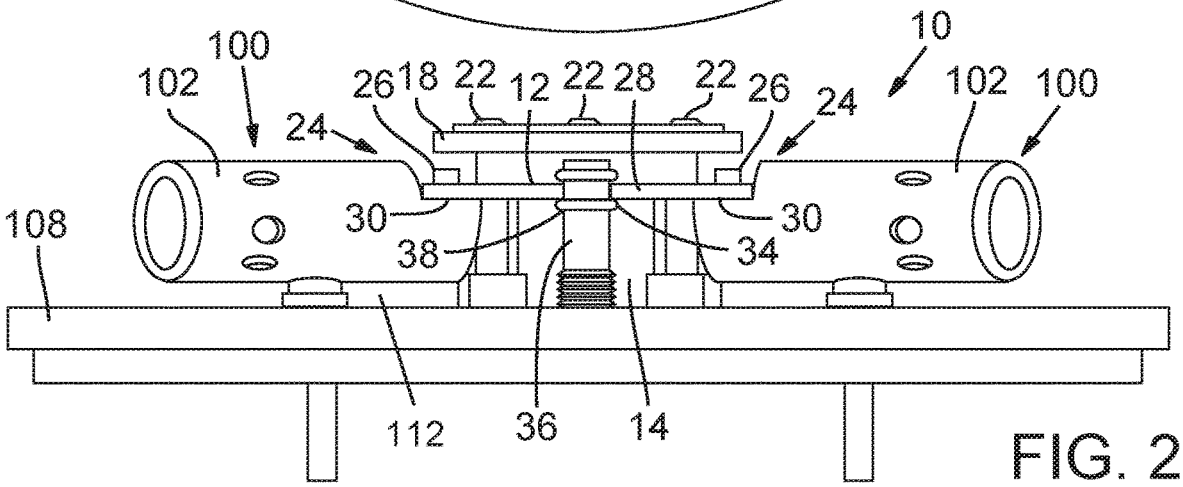
FIG. 2 is a side elevation view of the array of three boundary microphones illustrated in FIG. 1.

With specific reference to FIGS. 1 through 4, a first preferred embodiment of a boundary microphone assembly 10 according to the invention comprises three microphone assemblies 100 that are pivotally mounted to a suspension ring 12 that is suspended by elastic shock connectors and which surrounds a hub 14 that is mounted to a base board 108. As detailed below, the suspension ring 12 is mounted such that it is physically separated from all adjacent components of the assembly 10 for improved acoustic performance. The hub is preferably cylindrical, although it may be in other geometric configurations, and the hub houses an on-off switch (not shown) and LED status lights (also not shown). An upper, cylindrical plate 18 has a cylindrical center opening 20 that is sized to slide over hub 14 and is mounted to the board 108 with three posts 22 such that the cylindrical plate 18 is located at or near the upper end of the hub 14. As best seen in FIG. 2, the three posts 22 function as stand-offs to which the cylindrical plate 18 is mounted so that the plate is spaced above the board 108.

Figure 3:
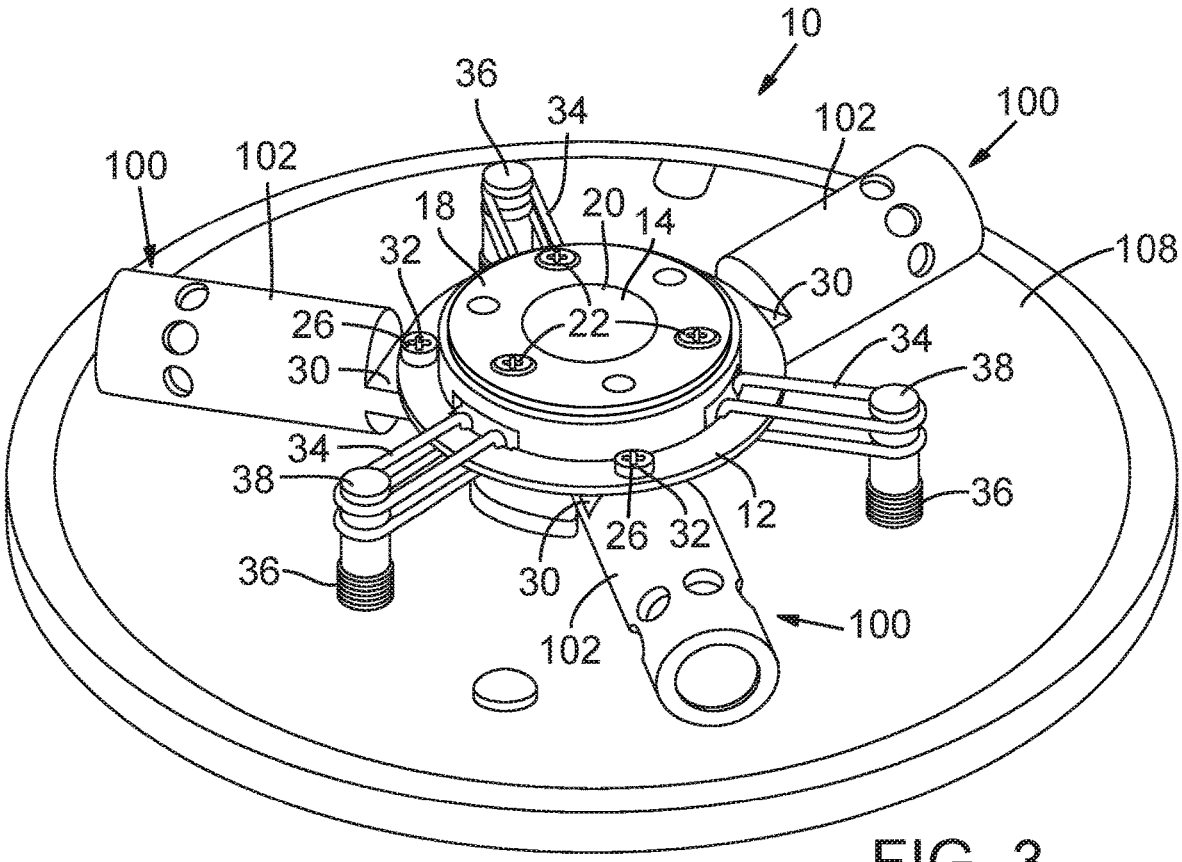
FIG. 3 is an upper perspective view of the three boundary microphones illustrated in FIG. 1.
Figure 4:
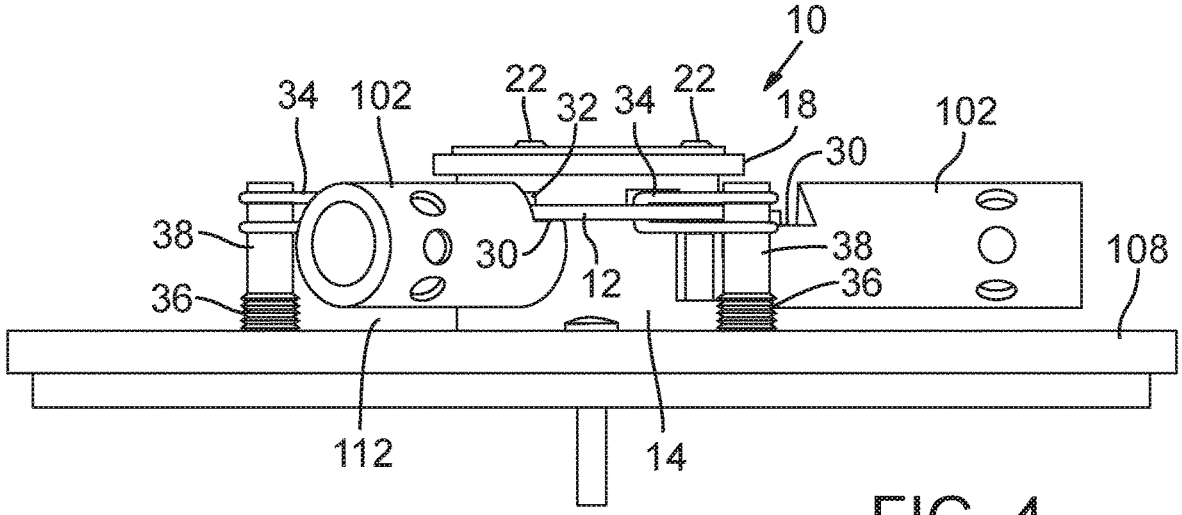
FIG. 4 is a side elevation view of the three boundary microphones shown in FIG. 1, and in which the drawing is taken from an angle to illustrate the shock mounting system.
Figure 5:
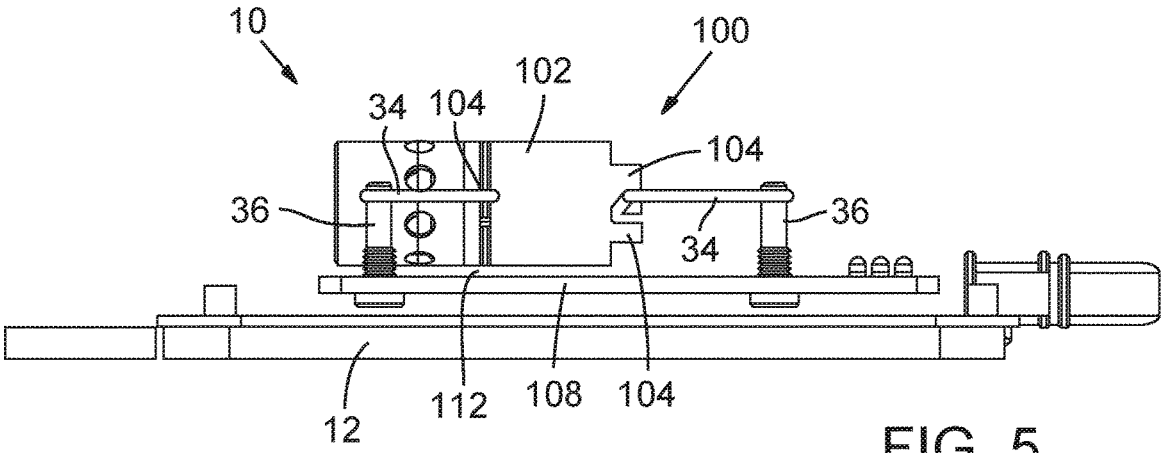
FIG. 5 is a side elevation view of second preferred embodiment of the invention described herein, and more particularly an internal shock-mounted boundary microphone illustrating the microphone housing with the cover removed to illustrate the internal components.

Each microphone assembly 100 is a conventional mic assembly of the type that may be used in a boundary microphone, except the enclosure 102 (which surround the microphone capsule and internal components, none of which are illustrated) of each mic is modified to include at the innermost end 24 (i.e., the ends of the enclosures 102 adjacent hub 12) a pivotal attachment points 26 for connecting the enclosures 102 to a cylindrical suspension ring 12 that surrounds the hub 14 and which defines a mount for the microphone assemblies 100. More particularly, as best shown in FIGS. 2 and 3, the innermost ends 24 of the enclosures 102 define a flattened shelf 30 that extends beneath the suspension ring 28. A screw 32 that defines the attachment point 26 extends through a bore formed in suspension ring 12 and is threaded into an aligned bore in flattened shelf 30 to attach the enclosure 102 to the suspension ring 12, while allowing the enclosure 102 to pivot relative to the suspension ring. As illustrated with the phantom lines in FIG. 1, each mic assembly 100 is pivotal through an arc A of about 70 degrees to allow for selective positioning of each of the three mic assemblies 100 in the embodiment of FIG. 1 at any angular orientation in the 70 degrees of angular adjustment. The mounting with screw 32 allows for pivoting and positioning of the mics without detents, and without the need to remove fasteners, point the mic, and reattach fasteners. It will be appreciated that the suspension ring 12 may be adapted to accommodate 2, 3 or 4 microphone assemblies 100.

The suspension ring 12 is suspended over board 108 with three elastic shock engagement elements, or shock cords 34 that define loops, and such that the suspension ring is physically separated from the hub 14 and plate 18. In the illustrated embodiment, each cord 34 is in the form of a ring that is looped over a post 36 that is mounted to and extends above board 108, extends around the suspension ring 12, and is looped back over the post 36, as illustrated. Circumferential grooves 38 may be formed in posts 36 to receive the ends of the shock cord, if desired, and similarly, notches may be formed in the interior circumference of the suspension ring 12 to receive the runs of the shock cords where they extend around the suspension ring. The length of the shock cords is such that the cord is under tension when the cord 34 is attached around the post 36, the suspension ring 12, and back around the post, as described, such that the mic assembly 100 is suspended over the board 108 with a space 112 between the lower side of the mic assembly and the board 108. The method of mounting suspension ring 12 just described results in each of the three microphone assemblies 100 being mounted to the suspension ring 12 such that the microphones assemblies are in turn suspended over the board 108 and such that the microphone assemblies are isolated from and not in contact with other components, and are positioned such as to be spaced above the board 108 (FIG. 4) by a space 112. The elastic shock elements 34 in combination with the suspended mounting of the microphone assemblies isolates the mics resulting in improved acoustic performance.

It will be appreciated that the manner of mounting the mic assemblies 100 with suspension elements 34 described above serves to isolate the mics so that they exhibit superior acoustic performance. Other equivalent structural mounts would include a rubber or elastic suspension ring with attachments points for the microphones.

Turning now to the embodiment illustrated in FIGS. 5 through 8, an alternative and preferred manner of mounting a single microphone assembly 100 using a shock cord mounting system is illustrated. As with the embodiment described above with respect to FIGS. 1 through 4, each microphone assembly 100 shown in FIGS. 5 through 8 is a conventional mic assembly of the type that is used in a boundary microphone except the enclosure 102 is modified to include plural attachment points 104, each of which is adapted for attaching a shock cord 34 as detailed below, and which together define a microphone assembly mount. The board 108 includes plural posts 36 that extend upwardly from the board 108 and which are mounted to the board around the periphery of the mic assembly 100 (as best shown in FIG. 3). A shock cord 34 is looped around and extends from a point on each of the posts 36 to an adjacent attachment point 104. The length of the shock cords is such that the cord is under tension when the cord is attached between the post and the attachment point and such that the mic assembly 100 is suspended over the board 108 with a space 112 between the lower side of the mic assembly and the board 108. The height of each post 36 is sufficient that the point of attachment of the shock cords always maintains the space 112 below the mic assembly and above the board.

The shock cords 34 are preferably an elastic material such as rubber. In the preferred embodiment there are 4 posts 36, each associated with an attachment point 104 on the enclosure 102.

Although the embodiment shown in the drawing includes four posts 36 and associated attachments points 104 and shock cords 34, each of which defines a mic assembly suspension attachment means, a greater or lesser number of such suspension attachment means will suffice to suspend the mic assembly 100 over the board 108 with a space 112 therebetween.

From the drawings it will appreciated that each microphone assembly 100 is at all times suspended over the board 108 so that it is isolated from the board and such that the only interconnection between the microphone assembly and any other structure is with the shock cords 34 and necessary electrical connections, if appropriate.

Figure 9:
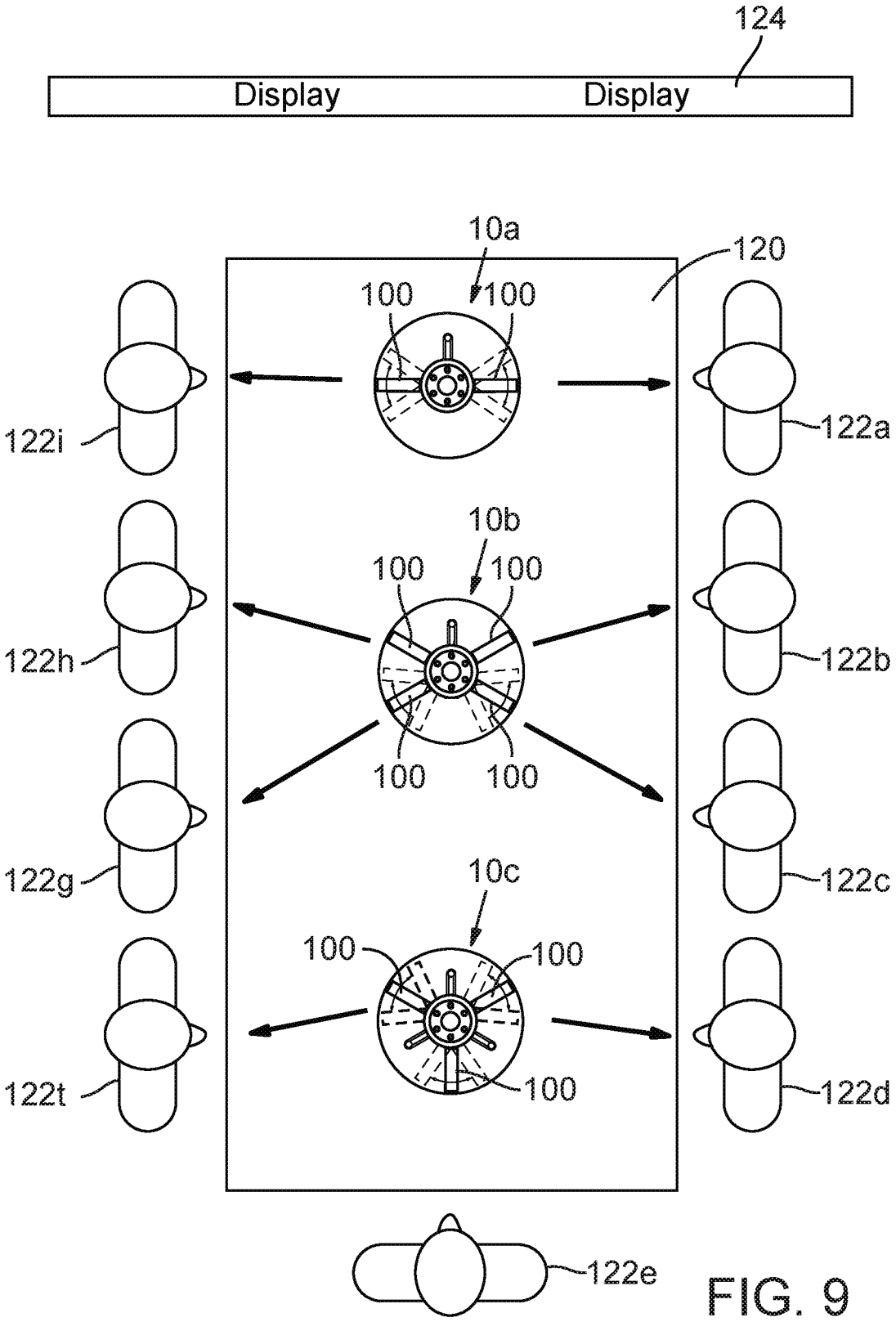
FIG. 9 is a top plan view of a typical installation of boundary microphones according to the present invention as positioned on a conference table.

Reference is now made to FIG. 9 in which three boundary microphone assemblies, labeled 10*a*, 10*b* and 10*c*, are located on a typical conference table 120. Nine meeting participants 122*a* through 122*i* are seated around the conference table 120 as might occur during a typical meeting, and a display 124 (such as a flat screen display) is positioned at one end of the table. The boundary microphone assembly 10*a* that is located nearest display 124 incorporates two microphone assemblies 100 of the type described above with respect to FIGS. 1 through 4. These two microphone assemblies 100 are oriented so that they point at participants 122*a* and 122*i*, respectively. As indicated above, each microphone assembly 100 is pivotally mounted to the suspension ring 12 so that each is pivotal through an arc of about 70 degrees. This adjustment arc is shown in phantom lines in FIG. 9 and allows the microphones to be positioned at any selected angular position such that they point directly at the intended participant to best pick up audio signals—voice—from that participant. Known boundary microphones assemblies that have plural individual microphones that are either fixed, or which allow for pre-set adjustments, allow one of the microphones to be pointed to a speaker at a conference table, but cannot be adjusted to point directly to multiple speakers without limiting the performance of the microphones and limiting sound quality. In contrast, the infinite adjustability of each microphone assembly 100 in the present invention (between the end points and through a 70 degree arc of adjustment) allows for precise pointing to the desired audio source for enhanced performance and sound quality.

The boundary microphone assembly 10*b* is located intermediately on the conference table 120 and incorporates four microphone assemblies 100. These four microphone assemblies 100 are angularly oriented so that they point at participants 122*b*, 122*c*, 122*g* and 122*h*, respectively. The boundary microphone assembly 10*c* that is located furthest from display 124 and incorporates three microphone assemblies 100 of the type described above. These three microphone assemblies 100 are oriented so that they point at participants 122*d*, 122*e*, and 122*f*.

As noted above, the hub 14 and suspension ring 12 described in respect of FIGS. 1 through 4 are cylindrical. It will be appreciated that these two components may be of other cooperative geometric configurations. For example, the hub may be rectangular, in which case the suspension ring would similarly be rectangular.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. A boundary microphone assembly, comprising:
- a microphone assembly having an enclosure;
- a suspension member;
- a mounting board extending generally parallel to the microphone assembly;
- plural posts mounted to the mounting board and extending upwardly therefrom;
- plural engagement elements, each engagement element extending between a post and the suspension member so that the suspension member is suspended by the plural engagement elements with a space between the suspension member and the mounting board; and
- wherein the enclosure of the microphone assembly is attached to the suspension member so that the microphone assembly is suspended with a space between the microphone assembly and the mounting board.

2. A boundary microphone assembly, comprising:
- a suspension member;
- a mounting board:
- plural posts mounted to the mounting board and extending away therefrom;
- plural engagement elements, each engagement element extending between a post and the suspension member so the suspension member is suspended by the plural engagement elements with a space between the suspension member and the mounting board:
- plural microphone assemblies, each having an enclosure, and wherein each enclosure of the plural microphone assemblies is attached to the suspension member so that each microphone assembly is suspended with a space between the microphone assembly and the mounting board.

3. The boundary microphone assembly according to claim 1 in which the enclosure is pivotally attached to the suspension member.

4. The boundary microphone assembly according to claim 3 in which the enclosure is pivotal through an arc of about 70 degrees so that the microphone assembly may be pointed in a desired direction at any point within the pivotal arc.

5. The boundary microphone assembly according to claim 2 in which each enclosure of each microphone assembly is pivotally attached to the suspension member.

6. The boundary microphone assembly according to claim 5 in which each enclosure is pivotal through an arc of about 70 degrees so that each microphone assembly may be individually pointed in a desired direction at any point within the pivotal arc.

7. The boundary microphone assembly according to claim 1 including a cylindrical hub mounted to the mounting board and wherein the suspension member is defined by a cylindrical ring encircling the cylindrical hub.

8. The boundary microphone assembly according to claim 7 in which the plural posts are mounted to the mounting board around the suspension member and each engagement element defines a closed elastic loop, wherein the loop extends around a post, over the suspension member, and back around the post.

9. A boundary microphone assembly, comprising:
- a suspension member;
- a mounting board;
- plural microphone assemblies, and wherein each microphone assembly is attached to the suspension member;
- plural posts mounted to the mounting board, and for each of the plural posts, an elastic connector extending between a post and the suspension member so that the suspension member is suspended by plural elastic connectors with a space between the mounting board and the suspension member and attached microphone assemblies.

10. The boundary microphone assembly according to claim 9 wherein each of the plural microphone assemblies comprises an enclosure with opposite ends and in which one of the opposite ends defines a flattened surface, and wherein the microphone assemblies are attached to the suspension member with a fastener extending through the suspension member and into a receptacle in the flattened surface of the microphone assembly.

11. The boundary microphone assembly according to claim 10 in which each microphone assembly is pivotally attached to the suspension member.

12. A boundary microphone assembly, comprising:
- at least one microphone assembly defining a longitudinal axis;
- a mounting board extending generally parallel to the longitudinal axis;
- plural posts attached to the mounting board;
- plural elastic cords, each elastic cord extending between a post and the microphone assembly so that the microphone assembly is suspended by the plural elastic cords with a space between the microphone assembly and the mounting board, wherein at least a first pair of cords is attached to the microphone assembly at a first location along the longitudinal axis and a second pair of cords is attached to the microphone assembly at a second location along the longitudinal axis that is spaced from the first location.

13. The boundary microphone assembly according to claim 12 in which the microphone assembly further comprises a microphone enclosure and plural elastic cord attachment points on the microphone enclosure.

14. The boundary microphone assembly according to claim 13 in which each elastic cord extends under tension between a post and an elastic cord attachment point on the microphone enclosure.

15. The boundary microphone assembly according to claim 14 wherein the microphone assembly is suspended over the mounting board.

16. The boundary microphone assembly according to claim 1, wherein the suspension member is configured as a ring, and the ring is positioned between the posts.

* * * * *